United States Patent [19]

Winkelmann et al.

[11] Patent Number: 4,533,611

[45] Date of Patent: Aug. 6, 1985

[54] PROCESS FOR PREPARING A PLANOGRAPHIC PRINTING PLATE

[75] Inventors: Detlef Winkelmann, Wiesbaden; Peter Padberg, Taunusstein, both of Fed. Rep. of Germany

[73] Assignee: Hoechst Aktiengesellschaft, Frankfurt am Main, Fed. Rep. of Germany

[21] Appl. No.: 488,697

[22] Filed: Apr. 26, 1983

[30] Foreign Application Priority Data

Apr. 29, 1982 [DE] Fed. Rep. of Germany ..... 3215940

[51] Int. Cl.[3] ..... G03G 13/16; G03G 13/28

[52] U.S. Cl. ..... 430/49; 430/31; 430/119; 430/126; 101/470; 101/471

[58] Field of Search ..... 430/31, 49, 126; 101/470, 471

[56] References Cited

U.S. PATENT DOCUMENTS

| | | | |
|---|---|---|---|
| 2,637,651 | 5/1953 | Copley | 430/126 X |
| 2,990,278 | 6/1961 | Carlson . | |
| 3,554,836 | 1/1971 | Steindorf | 156/240 |
| 3,753,760 | 8/1973 | Kosel . | |
| 3,798,029 | 3/1974 | Saklikar | 430/31 X |
| 3,804,620 | 4/1974 | Wells . | |
| 3,820,985 | 6/1974 | Gaynor et al. | 430/126 X |
| 4,027,964 | 6/1977 | Fantuzzo et al. | 355/10 |
| 4,157,974 | 6/1979 | Brechlin et al. . | |

FOREIGN PATENT DOCUMENTS

| | | | |
|---|---|---|---|
| 731812 | 4/1966 | Canada | 430/31 |
| 1075300 | 4/1980 | Canada . | |
| 2418240 | 10/1975 | Fed. Rep. of Germany . | |
| 1215599 | 12/1970 | United Kingdom . | |
| 1329341 | 9/1973 | United Kingdom . | |

OTHER PUBLICATIONS

Xerox Disclosure Journal: vol. 3, No. 4, Jul./Aug. 1978.

*Primary Examiner*—Roland E. Martin

*Attorney, Agent, or Firm*—Schwartz, Jeffery, Schwaab, Mack, Blumenthal & Evans

[57] ABSTRACT

Disclosed is a process for preparing a planographic printing plate by electrophotographic or electrographic means by producing a charge image on a photoconductive or highly insulating layer, developing the image onto the free surface of a dielectric intermediate carrier in contact with the photoconductor or highly insulating layer by means of a developer, which comprises dispersed thermoplastic particles having a melting range from about 90° to 130° C., and transferring and fixing the toner image to the planographic printing plate at a temperature within the melting range of the thermoplastic particles after the intermediate carrier has been separated from the charge image.

22 Claims, 1 Drawing Figure

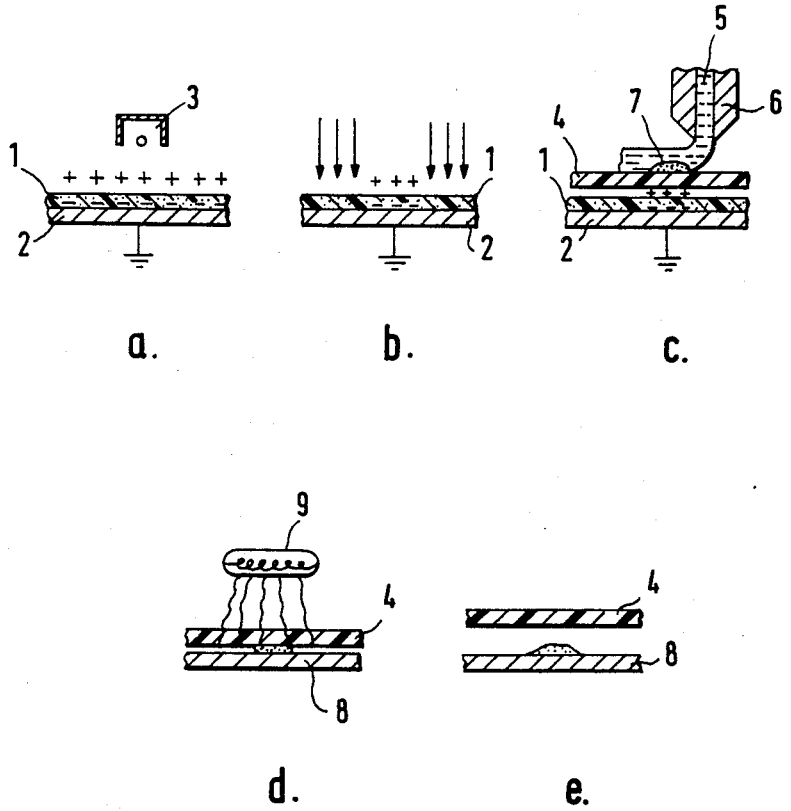
3
1
2
a.
1
2
b.
5
7
6
4
1
2
c.
9
4
8
d.
4
8
e.

PROCESS FOR PREPARING A PLANOGRAPHIC PRINTING PLATE

BACKGROUND OF THE INVENTION

The present invention relates to a process for preparing a planographic printing plate by electrophotographic or electrographic means. Specifically, the process comprises producing a charge image on a photoconductive or highly insulating layer, developing this image on the free surface of a dielectric intermediate support in contact with the photoconductive or highly insulating layer through use of a developer, transferring the toner image to a planographic printing plate, and fixing the toner image.

There has been described in U.S. Pat. No. 2,990,278 a process wherein an electrophotographically produced toner image is transferred by means of a corona from a photoconductor cylinder to a continuous intermediate support web. The toner image is heated on the web until it becomes tacky, whereupon it is transferred to the final image support. The intermediate support web may consist of polytetrafluoroethylene, an abhesive plastic sheet or a glassy material. The final image support is a roughened aluminum or zinc plate of the type preferably used in printing.

U.S. Pat. No. 3,554,836 discloses a device wherein at least one monolayer of a developer powder is transferred imagewise as a toner image to a continuous tape which is rolled around several rolls to form an intermediate support having a silicone elastomer surface. An infrared lamp is situated at the underside of the web which is transparent to radiation. The developing powder is directly heated by the radiation absorbed by the web. It is also possible to heat the intermediate support web in its entirety, so that the powder is softened by contact heat. By means of another roll, the sheet-shaped image support is brought into contact with the developer powder on the web so that the powder is transferred to the image support. The image support used is, for example, aluminum.

In both processes the toner image is tranferred twice, namely, once from the photoconductor surface to the intermediate support, and then from the intermediate support to the final image support. In the course of these transfers, image resolution suffers.

There is also known an electrostatographic imaging process (German Patent No. 2,200,084, equivalent to U.S. Pat. No. 4,027,964) wherein a photoconductive recording material is covered with a thin dielectric web prior to the development of the charge image. The developer liquid is then applied to the web, with the toner image obtained being transferred to the final image support. The latter step is performed before separating the dielectric tape from the recording material and is necessary to prevent physical or electrostatic distortion of the toner image. The process can only employ a polar developer liquid which is applied by means of an applicator element, such as a roll, whose surface is evenly patterned with elevations and recesses. The dielectric intermediate support web is 3–75 μm thick, and preferably consists of a polypropylene or polyvinyl fluoride film. The toner image is transferred to the final image support by means of pressure and/or with the aid of an electric voltage bias. The image support mentioned is primarily ordinary paper. Of special interest is electrophoretic developing with negatively charged toner particles, instead of developing with a polar developer liquid. An applicator roll is used which has a smooth surface and which is in even contact with the film of liquid. However, the very low density of the toner images thus prepared renders the process unsuitable for practical use.

German Offenlegungsschrift No. 2,418,240 describes an electrophotographic copying process wherein an electrostatic image is developed with a liquid developer on a final web-shaped image support, in the form of a thin film, by bringing the reverse face of the image support, the front of which is lying flat against the photoconductor cylinder carrying the electrostatic image, into contact with the liquid developer. In this process, the electrostatic field of the charge image penetrates through the thin film, as a consequence of which the toner particles dispersed in the liquid developer can migrate in the direction of the photoconductor cylinder. The particles adhere to the reverse face of the film, and form the fixable toner image. Although this method advantageously results in the use of an uncoated thin image support, the elimination of the cleaning of the residual developer from the photoconductor surface and possibly even the preparation of several copies from one charge image, the handling of the thin film as an image support proves to be highly problematic and leads to considerable technical difficulties.

German Offenlegungsschrift No. 2,125,013 discloses a process for the production of copies, in which an electrostatic charge image is developed by a toner with the toner image being transferred to a final support. The process involves the steps of covering the induced charge image with an insulating film and developing the induced charge image with a toner, pressing the final support against the toner image-carrying film, removing the film and final support from the toner image, and finally separating the film and the final support. This process has the disadvantage that, before the film is removed from the charge image, the final support must be applied onto the toner image-carrying film, otherwise, the toner image will be destroyed before the final support will have been applied to the film.

Further, a process for producing copies by applying an electrostatic charge is described in German Offenlegungsschrift No. 2,125,050. In this process, development is performed by means of a liquid, conductive toner. The electrostatic charge image is covered with a thin film, and the charge image is transferred to the film by induction and developed with the toner. Thereafter, the film is dyed with a toner-repellant dyed substance, while the toner image is still wet, and the liquid is transferred to a suitable support, using a method known in offset printing. Processes of this kind have been found to be rather complicated, however, and therefore, have not gained general acceptance.

SUMMARY OF THE INVENTION

It is therefore an object of the present invention to provide an improved process for preparing a planographic printing plate by electrophotographic or electrographic means.

It is another object of the present invention to provide a planographic printing plate having crisp images on a readily handled image support.

Yet another object of the present invention is to provide a planographic printing plate by electrophotographic or electrographic means utilizing only one toner image transfer stage.

In accomplishing the foregoing objects, there has been provided in accordance with the present invention a process for preparing a planographic printing plate by electrophotographic or electrographic means, comprising the steps of producing a charge image on a photoconductor or highly insulating layer, applying a dielectric film as an intermediate support to the photoconductor or insulating layer, applying a liquid developer to the free surface of the intermediate support to develop the image on the free surface, the developer comprising an electrophoretically active liquid developer comprising thermoplastic, dispersed particles having a melting range from about 90° C. to 130° C., separating the intermediate support from the photoconductive or insulating layer, transferring and fixing the toner image to the planographic printing plate at a temperature within the melting range of the thermoplastic particles and separating said intermediate support from the planographic printing plate.

In one embodiment the developer comprises an electrophotographic dispersion liquid developer having a liquid phase having a specific volume resistivity greater than about $10^{13}$ ohm.cm and a finely, divided solid phase of electrophoretically or dielectrophoretically depositable particles dispersed in the liquid phase.

Surprisingly, it has been found that, contrary to known processes, the process of the present invention makes possible the removal of the toner image produced on the dielectric film from the charge image and the transfer of the image to the final support, without destroying the toner image.

Further objects, features and advantages of the present invention will become apparent from the detailed description of preferred embodiments which follows, when considered together with the attached FIGURE of drawings.

BRIEF DESCRIPTION OF THE DRAWINGS

The FIGURE is a schematic representation of the steps of the present process.

DETAILED DESCRIPTION OF PREFERRED EMBODIMENTS

Referring first to the FIGURE, in the process step a, a photoconductive layer 1 positioned on a metallic or metalized support 2 is evenly charged in the dark with a corona 3. In the subsequent step b, the photoconductive layer 1 is subjected to image-wise exposure. The exposure is preferably accomplished by means of optical imaging in a reprographic camera or by re-enlarging a microfilm image; however, it is also possible to irradiate the photoconductive layer dot by dot with a laser beam which is passed in straight lines over the layer and is imagewise switched on and off by a digital mechanism. In principle, it is also possible to perform a contact exposure. Irrespective of the exposure process, there results a charge image which can be developed.

In the subsequent step c, the photoconductive layer bearing the charge image is covered with a thin film 4 used as a dielectric intermediate support. Step c must be carried out without forming bubbles or creases. If single films are used as intermediate supports, a roller or an air brush can be of assistance in accomplishing this. If the intermediate carrier 4 is wound from one roll onto another roll, it is sufficient to press it smoothly under tension onto the charge image.

The liquid developer 5 is then applied to the free surface of the intermediate carrier 4. This can be carried out with any prior art applicator, such as, for example, wetted rolls or, as shown, slot dies 6. It is advisable to use a developer electrode to eliminate the residual voltage on the photoconductive layer in the exposed areas. The developing process itself takes from a few seconds up to one minute. Excess developer liquid can run off or is blown or squeezed off, after which the toner image 7 remains.

In the process step d, the image-bearing intermediate support 4 is lifted from the photoconductive layer 1 and placed onto a planographic printing plate 8, for example lithographic aluminum, with the imaged surface of the support contacting the printing plate. This step must likewise by carried out without forming bubbles or creases. The toner image is then softened, or melted, by applying heat and transferred to the aluminum surface. If necessary, the transfer may be conducted at a somewhat elevated pressure. Provided the components have been chosen correctly, the transfer can be practically 100% complete.

Step d illustrates heating in the transfer step by the direct application of radiated heat 9. In the case of a transparent film as the intermediate support, the heat is mainly absorbed in the toner, provided it is colored. However, heating can also be effected in the form of contact heat with the aid of a heated roll or hot plate. In every case the temperature is chosen in such a manner that the film used as the intermediate support does not deform. A temperature range between about 90° and 130° C. has been found to be suitable.

In the process step e, the intermediate carrier 4 and the planographic printing plate 8 bearing the toner image are then separated from each other. It is advantageous to carry out this step only when the laminate has cooled down to a temperature of less than 40° C. The image-bearing planographic printing plate thus obtained can be used directly in offset printing. Depending on the type of toner, from 10,000 to more than 100,000 prints can be obtained with this plate.

Compared to the known processes, wherein two transfer steps are used, the process according to the present invention has the advantage that the single transfer produces crisper images on the planographic printing plate. Compared to the process of German Auslegeschrift No. 2,200,084, (corresponding to U.S. Pat. No. 4,027,964) wherein the image is not directly developed onto the photoconductive recording material, but, is instead, developed onto an adjacent film, the process according to the present invention has the advantage that the electrophoretically active liquid developer, which is unsuitable in the prior art process, bonds the toner image so firmly to the intermediate support that the latter can be removed from the photoconductor layer without distorting the image. This, in turn, permits the heat-assisted transfer onto the planographic printing plate without residue accumulation. Such a transfer would be impossible according to the known process, wherein the photoconductor is still present, since all suitable photoconductors are damaged in the heat treatment.

The process according to the invention can be carried out in various embodiments. For example, the photoconductive or highly insulating layer freed from the intermediate support can normally be re-used. The number of re-uses depends upon the quality of the layer and ranges from at least a few re-uses to a few thousand re-uses depending on quality requirements. Under normal circumstances, the number of re-uses will total in the hundreds.

In one embodiment of the process, as already indicated, the charge image is not produced electrophotographically, but electrographically by the image-wise spraying of charge onto a dielectric layer. The charge image-producing step electrophotographically comprises the substep of charging said photoconductive layer and subsequently subjecting said layer to image-wise exposure. The charge image-producing step electrographically comprises the substep of image-wise charging said highly insulating layer.

In another embodiment, the intermediate support is applied to the charged photoconductive layer even before exposure.

Due to its pronounced insulating properties, the intermediate support tends to attract dust. It is therefore advisable to carry out an additional, dust-removal step before the intermediate support is placed on the photoconductive layer. The dust can be removed with brushes made of thin metal wires, for example, by alternating current discharge followed by brushing, or by using a weak alpha emitter, for example, polonium, again followed by brushing.

Instead of applying a counter-voltage to the electrode during the developing, it is possible to coat the surface of the intermediate carrier by means of a corona discharge with a small amount of charge of the same sign as that of the charge image. This leads to somewhat sharper and thinner toner images which are freer of background toning. Any toner deposition in the non-image areas can also be reduced by an additional rinsing step with the dispersant of the liquid developer.

To suppress gas discharges in the gap between the photoconductive layer and the intermediate support when they are being separated from each other, the photoconductor layer and/or intermediate support can be provided with a very thin layer of an insulating liquid, preferably the liquid phase of the liquid developer, before being placed on top of each other, or the separation can be carried out in such a liquid.

Provided the intermediate support is sufficiently stiff and transfer takes place without complications, the intermediate support can also be re-used after it has been cleaned. It is advantageously cleaned either with the liquid developer itself or with the liquid phase thereof. Excess cleaning liquid can be wiped off with a wiper blade.

When aluminum that has a particularly porous surface is used as the planographic printing plate it is advisable to re-heat the toner image, so that the toner can flow into the recesses of the surface. This leads to longer print runs.

Any substance which is customarily used as a photoconductor for electrophotographic purposes can be used as a photoconductor in the process according to the invention. While these photoconductors can comprise inorganic layers of selenium or its alloys, cadmium sulfide or zinc oxide, organic photoconductor layers are preferred, since such layers are more flexible and, as a rule, exhibit smaller voltage drops in the dark. Because of the somewhat time-consuming process steps, photoconductor layers which exhibit more than 50% of the original voltage after one minute are preferred. Of the organic photoconductor layers, particularly preferable are the double-layer type comprising a layer producing the charge carriers and a charge transport layer, since these combine high light-sensitivity with a small decrease in the dark. The voltage above the layer should be between about 200 and 1,000 volt, preferably between about 300 and 500 volt. As is known, examples of supports for the photoconductive or highly insulating layer comprise metallic plates or cylinders or plastic films which have a thin metal layer vapor-deposited thereon.

The dielectric intermediate support comprises any plastic film having a volume resistance of greater than about $10^{12}$ ohm.cm, and not susceptible to shrinkage below the melting point of the thermoplastic toner particles which would lead to dimensional changes in the toner image to be applied. Suitable films comprise, for example, polypropylene, polyethylene, polystyrene and polyvinyl chloride. Preferred films include oriented polyethylene terephthalate or polycarbonate films of the type used in preparing capacitors. If particularly pronounced abhesive properties are required, it is also possible to use films made of polytetrafluoroethylene. It is even advantageous to use films which have been suitably coated to adapt the surface energy. It has been found that the dielectric constant is not critical for the process according to the invention. Particularly good results have been obtained with films which have a dielectric constant of about 3.

The thickness of the intermediate carrier determines the resolution, i.e., the thinner the intermediate carrier, the higher the resolution. Since the intended use proposed, namely offset printing, requires a resolution of about 10 pairs of lines per mm, the thickness of the intermediate carrier is varied accordingly. As experiments demonstrate, this requirement can be met with thicknesses within the range from about 5–50 μm. A thickness within the range from about 10 to 15 μm advantageously represents an acceptable compromise between the ease with which the intermediate carrier can be handled and the crispness of the print. Where smaller resolutions are acceptable, as, for example, in poster printing, it is also possible in some cases to use slightly thicker intermediate supports.

Electrophoretically active liquid developers which are known as electrophotographic dispersion liquid developers, consist of an insulating liquid which has a specific volume resistivity of greater than about $10^{13}$ Ohm.cm and contain dispersed electrophoretically or dielectrophoretically depositable particles. The dispersants extensively used in industry are branched aliphatic hydrocarbons having a boiling point of greater than about 150° C. The dispersed particles are usually pigments, since a colored image is as a rule required. However, this is not absolutely necessary for the purposes of the present invention, although it is advantageous for easier handling. The depositable pigments can be rendered fixable with a dissolved binder or with a polymer which deposits together with the pigment. The dispersed binder component is essential to the process according to the invention. The components have to be polymers which are not only dispersible and chargeable with charge of one sign but also have to form a paste or liquid within a melting range or at a defined melting point between about 90 and 130° C. when freed from adhering dispersant. Finely divided dispersed thermoplastics, such as polyamides, polyethylenes or copolymers of styrene or of acrylate or methacrylate, or mixtures thereof are suitable. These are preferably milled dry, dispersed in the insulating liquid, and additionally milled, for example in a ball mill, to the required particle size of less than about 5 μm, preferably less than about 2 μm. The depositable particles preferably contain polyamide, polyethylene or copolymers of styrene or of acrylate or methacrylate alone or mixed or, at least, include these polymers in their compositions. Controlling agents which give the dispersed particles an unambiguous charge are also added. The controlling agents can be either inorganic or organic compounds. Specific examples are polyvinyl pyrrolidone as a negative-controlling agent and long-chain zirconyl salts as a positive control.

Another means for obtaining highly dispersed thermoplastics is to dissolve them in the hot dispersant and then to cool down the solution sufficiently to precipitate the thermoplastic in finely divided form. Copolymers of vinyl toluene/octyl acrylate are particularly suitable for this method of preparation. The copolymers of this type require additional control, in the manner described above. This type of liquid developer is described in German Offenlegungsschrift No. 2,333,065 which is equivalent to U.S. Pat. No. 4,157,974.

However, the process according to the invention preferably uses dispersimer developers, which are known from German Auslegeschrift No. 2,114,773, equivalent to U.S. Pat. No. 3,753,760. These are liquid developers wherein a dispersed polymeric phase has been prepared in the insulating liquid by directly converting monomers dissolved in the liquid into finely divided polymers. This process leads to the most uniform particle size distribution when a soluble prepolymer is prepared, onto which products which are insoluble in the polymeric form are then grafted. Particularly suitable prepolymers are copolymers of stearyl methacrylate/glycidyl methacrylate which are esterified with methacrylic acid. This way of preparing a finely divided polymeric phase in a highly insulating liquid offers the possibility, by means of a suitable choice of monomers, not only to affect the thermal properties of the polymers but, at the same time, of controlling them correctly. For instance, by using vinylpyridine, allylamine or vinylamine it is possible to prepare positively charged particles. In contrast, free acid groups, which can be obtained by graft-copolymerizing maleic or fumaric acid, lead as a rule to negatively charged particles.

In each of the cases described above, it is advisable to disperse pigments together with the dispersed thermoplastic particles or to color the particles. Although it is not strictly necessary for the purposes of the process according to the present invention, it facilitates visual inspection of the toner deposition and favors thermal fixation when irradiation is involved.

To obtain as dense a deposition of the dispersed particles as possible, it is advantageous if the particles have a low specific charge within a range from about 50 to 500 μC/g.

Lithographic aluminum is preferably used as the planographic printing plate. This aluminum is obtainable in thicknesses from about 50 μm to 400 μm. It is possible to use materials of any surface texture customary for this purpose, i.e., materials whose surface has been mechanically roughened dry or liquid, as well as materials which have been roughened chemically or electrochemically and then anodized. Since the bonding conditions on the various pretreated kinds of aluminum are different, the toner has to be adapted to these conditions. It has been found advantageous if the dispersed polymeric particles contain acrylate or methacrylate groups. In this case, the polymer forms such a firm bond with the oxide layer that its adhesion to the aluminum surface is significantly greater than that of the melted toner to the intermediate support so that a virtually 100% transfer results. Another factor which should be taken into account is the thermal conductivity of the aluminum during the transfer step of the toner image from the intermediate support to the aluminum surface. Given feed rates of 1 m/min or greater, it is advisable to cover the reverse face of the aluminum to avoid substantial heat losses due to conduction and radiation.

The present invention is further illustrated by the following non-limiting example.

EXAMPLE

A photoconductor layer comprised of about 50 percent by weight of 2,5-bis-(p-diethylaminophenyl)-1,3,4-oxadiazole and about 50 percent by weight of a styrene/maleic anhydride copolymer, as well as of Astrazone Orange G (C.I. 48,035) as a sensitizer, and which had been applied in a thickness of 5 μm to brushed aluminum, was charged with a single-wire corona to −400 V. It was then subjected to image-wise exposure in a reprographic camera, the plate receiving about 40 $\mu J/cm^2$ at the exposed areas and being thereby discharged down to −20 V. The electrostatic charge image thus obtained was covered with a 12 μm thick biaxially oriented polyethylene terephthalate film. A liquid developer of the dispersimer type was poured onto the film and left thereon for 20 seconds. This developer consisted of a dispersimeric polymer and carbon black in a weight ratio of 10:1. The dispersimer had been obtained by graft-copolymerizing methacrylic acid and butyl methacrylate in a molar ratio of 1:3 onto a glycidyl methacrylate prepolymer which had been esterified with methacrylic acid and had been dissolved in an aliphatic hydrocarbon having a boiling range from 160° to 180° C., in a weight ratio of 1:30 of prepolymer to grafted polymer. The concentrate thus prepared was diluted in a weight ratio of 1:100 with an aliphatic hydrocarbon as a dispersant, and controlled with 0.1 ml of a zirconyl octoate solution to a 1 percent by weight concentrate. The toner had a positive charge. When the toner had been deposited onto the film serving as an intermediate support the remaining dispersant was blown off with an air brush. The film bearing the air-dried toner image was then lifted from the photoconductive layer and applied to a chemically roughened and anodized aluminum of 0.3 mm thickness. The assembly was passed at a speed of 0.5 m/min through a laminator, the rolls of which had a temperature of 120° C. After cooling, the film was lifted from the aluminum plate.

A crisp background-free toner image was obtained on the aluminum surface. To improve the adhesion, the image-wise tonered aluminum plate was then placed for 20 seconds in an oven having a temperature of 150° C. The planographic printing plate thus obtained was preserved in a customary manner with a hydrophilic layer, and could then be used for printing at any desired time. On a conventional, small offset machine it was possible to print 50,000 sheets before the first signs of wear appeared in the toner image.

What is claimed is:

1. A process for preparing a planographic printing plate by electrophotographic or electrographic means, comprising the steps of:

on a photoconductive or highly insulating layer which provides a first surface and a second surface, producing a charge image on said first surface;

applying a dielectric film as an intermediate support to said first surface of said photoconductive or insulating layer, whereby said charge image is covered by said intermediate support;

developing a toner image on the free surface of said intermediate support, said toner image corresponding to said charge image, by applying a liquid developer to said free surface of said intermediate support, said developer comprising an electrophoretically active liquid developer comprising thermoplastic, dispersed particles which (a) have a melting range from about 90° C. to 130° C. and (b) are comprised of at least one thermoplastic selected from the group consisting of a polyamide, polyethylene, a copolymer of styrene, and a copolymer of acrylate or methacrylate;

separating said intermediate support from said photoconductive or insulating layer;

transferring and fixing said toner image to the planographic printing plate by (i) applying said intermediate support to a planographic printing plate, such that said toner image is immediately adjacent to said planographic printing plate, (ii) applying heat such that said toner image is softened for melt transfer, and (ii) transferring said toner image by melt transfer to said planographic printing plate; and separating said intermediate support from said planographic printing plate.

2. A process as defined in claim 1, wherein said separating step is performed at a temperature of less than about 40° C.

3. A process as defined in claim 1, wherein said charge image is produced electrophotographically.

4. A process as defined in claim 1, wherein said charge image is produced electrographically.

5. A process as defined in claim 1, wherein said step of producing a charge image comprises charging a photoconductive layer and subsequently subjecting said photoconductive layer to imagewise exposure.

6. A process as defined in claim 1, wherein said step of producing a charge image comprises imagewise charging a highly insulating layer.

7. A process as defined in claim 5, wherein said intermediate support is applied to said photoconductive layer prior to said imagewise exposure.

8. A process as defined in claim 1, wherein said photoconductive layer comprises an organic photoconductor layer.

9. A process as defined in claim 8, wherein said organic photoconductor layer comprises a charge carrier generating layer and a charge transport layer.

10. A process as defined in claim 1, wherein said electrophoretically active liquid developer comprises an electrophotographic dispersion liquid developer comprised of a liquid phase having a specific volume resistivity greater than about $10^{13}$ Ohm.cm and a finely, divided solid phase of electrophoretically or dielectrophoretically dispositable particles dispersed in said liquid phase.

11. A process as defined in claim 1, wherein said particles are comprised of a copolymer of acrylate or methacrylate.

12. A process as defined in claim 10, wherein said developer further comprises disperse pigments.

13. A process as defined in claim 1, wherein said intermediate support comprises a plastic film.

14. A process as defined in claim 1, wherein said intermediate support has a volume resistivity of greater than about $10^{12}$ Ohm.cm.

15. A process as defined in claim 1, wherein the thickness of said intermediate support ranges from about 5 to 50 μm.

16. A process as defined in claim 15, wherein the thickness of said intermediate support ranges from about 10 to 15 μm.

17. A process as defined in claim 1, wherein the planographic printing plate comprises aluminum.

18. A process as defined in claim 17, wherein the thickness of said aluminum ranges from about 50 to 400 μm.

19. A process as defined in claim 1, wherein said step of developing said toner image comprises applying said liquid developer to said free surface of said intermediate support and then removing any excess of said liquid developer from said free surface.

20. A process as defined in claim 1, wherein said step of transferring and fixing said toner image comprises applying heat under elevated pressure.

21. A process as defined in claim 1, wherein said step of transferring and fixing said toner image comprises applying heat such that said toner image is melted.

22. A process as defined in claim 1, further comprises, after said step of separating said intermediate support from said planographic printing plate, the step of heating said planographic printing plate to improve adhesion thereto of said toner image.

* * * * *